US007404304B2

(12) United States Patent
Yang et al.

(10) Patent No.: US 7,404,304 B2
(45) Date of Patent: Jul. 29, 2008

(54) DRUM TYPE WASHING MACHINE WITH HEATER USING STEAM AND HOT WATER

(75) Inventors: Byoung Yull Yang, Ansan-Si (KR); Hyung Gyoon Kim, Suwon-Si (KR); Sang Yeon Pyo, Suwon-Si (KR); Seon-Woo Park, Suwon-Si (KR); Hye Soon Yang, Yongin-Si (KR); Seong Min Oak, Masan (KR); Seung Ju Choi, Suwon-Si (KR); Jae-Ryong Park, Suwon-Si (KR); Hyun Sook Kim, Suwon-Si (KR)

(73) Assignee: Samsung Electronics Co., Ltd., Suwon (KR)

( * ) Notice: Subject to any disclaimer, the term of this patent is extended or adjusted under 35 U.S.C. 154(b) by 556 days.

(21) Appl. No.: 10/976,794

(22) Filed: Nov. 1, 2004

(65) Prior Publication Data

US 2005/0132504 A1 Jun. 23, 2005

(30) Foreign Application Priority Data

Dec. 23, 2003 (KR) ..... 10-2003-0095536

(51) Int. Cl.
*D06F 39/04* (2006.01)

(52) U.S. Cl. ..... 68/5 C; 68/15

(58) Field of Classification Search ..... 8/149.3, 8/158–159, 149.2; 68/5 R, 5 C, 23 R, 23.5, 68/15

See application file for complete search history.

(56) References Cited

U.S. PATENT DOCUMENTS

| | | | | |
|---|---|---|---|---|
| 1,376,227 | A * | 4/1921 | Rabezzana | 68/151 |
| 1,755,101 | A * | 4/1930 | Clark et al. | 34/187 |
| 3,443,406 | A * | 5/1969 | Wolverton et al. | 68/58 |
| 6,520,122 | B2 * | 2/2003 | Kemp et al. | 122/504.2 |
| 6,849,094 | B1 * | 2/2005 | North | 8/149.1 |
| 7,290,412 | B2 * | 11/2007 | Yang et al. | 68/5 C |
| 2005/0132503 | A1 * | 6/2005 | Yang et al. | 8/149.3 |
| 2005/0262644 | A1 * | 12/2005 | Oak et al. | 8/158 |

FOREIGN PATENT DOCUMENTS

| | | |
|---|---|---|
| JP | 2000-176192 A | 6/2000 |
| JP | 2003-019382 A | 1/2003 |
| JP | 2003-093775 A | 4/2003 |

* cited by examiner

*Primary Examiner*—Joseph L Perrin
(74) *Attorney, Agent, or Firm*—Sughrue Mion, PLLC

(57) ABSTRACT

A drum type washing machine, where steam and hot water are supplied to heat wash water, including: a water tub for containing wash water; a rotating drum rotatably mounted in the water tub and having, at a peripheral wall thereof, a plurality of through holes; a heating tank for heating water and generating steam; a water supply unit for supplying water into the water tub and the heating tank; and a steam supply pipe, adapted to guide the steam from the heating tank to the water tub, connected to the water tub In this drum type washing machine, the temperature of wash water can be rapidly increased in accordance with steam and hot water supplied into the water tub. Accordingly, it is possible to reduce the overall wash time while reducing the amount of wash water to be used.

12 Claims, 4 Drawing Sheets

DRUM TYPE WASHING MACHINE WITH HEATER USING STEAM AND HOT WATER

CROSS-REFERENCE TO RELATED APPLICATION

This application is based upon and claims the benefit of priority from Korean Patent Application No. 2003-95536, filed on Dec. 23, 2003 in the Korean Intellectual Property Office, the entire contents of which is incorporated herein by reference.

BACKGROUND OF THE INVENTION

1. Field of the Invention

The present invention relates to a drum type washing machine and a method of use thereof, and more particularly to a drum type washing machine in which steam and hot water are supplied into a washing tub to rapidly increase the temperature of wash water.

2. Description of the Related Art

Drum type washing machines generally perform a laundry washing process by raising laundry, together with wash water, along a cylindrical rotating drum containing the laundry and wash water, and subsequently dropping the laundry and wash water, during rotation of the cylindrical rotating drum. An example of such a drum type washing machine is disclosed in Japanese Patent Laid-open Publication No. 2001-149685. This drum type washing machine is configured to perform a washing process using heated wash water.

The disclosed drum type washing machine includes a water tub for containing wash water, a rotating drum rotatably mounted in the water tub and provided with through holes for spin-drying at a peripheral wall thereof, and a heater for heating the wash water contained in the water tub. In a wash cycle of the drum type washing machine, washing of laundry is carried out as the rotating drum rotates within the water tub at a relatively low speed under the condition in which wash water and detergent have been supplied into the water tub. In order to effectively wash the laundry, the wash water is used in the wash cycle in a state of being heated by the heater.

However, the disclosed drum type washing machine has a problem in that a great deal of time is required to heat the wash water to a desired wash temperature. This is because a large amount of wash water supplied into the water tub is heated entirely by the heater disposed at the bottom of the water tub, which increases the overall wash time.

Furthermore, the conventional drum type washing machine wastes wash water because the wash water must fill the heater case installed at the bottom of the water tub. Energy is also wasted because it is necessary to heat the water contained in the heater case.

SUMMARY OF THE INVENTION

Therefore, an object of the invention is to provide a drum type washing machine in which steam and hot water are supplied into a water tub, so as to rapidly raise the temperature of wash water. This arrangement reduces the total wash time, reduces the amount of wash water to be used, and reduces the consumption of energy caused by heating of the wash water.

In accordance with the present invention, this object is accomplished by providing a drum type washing machine comprising: a water tub for containing wash water; a rotating drum, rotatably mounted in the water tub, comprising a plurality of through holes formed along a peripheral wall thereof; a heating tank for containing water and generating steam comprising a heater for heating the water contained therein; and a steam supply pipe, adapted to guide the steam from the heating tank to the water tub, comprising an inlet connected to the heating tank and an outlet connected to the water tub. The water tub and rotating drum each may be provided with an access opening on the respective front walls thereof, the outlet of the steam supply pipe may be connected to the water tub at a peripheral wall or a rear wall of the water tub, and the heating tank may generate steam from a predetermined amount of water.

The washing machine may be further provided with a driving unit for driving the rotating drum, a water supply unit for supplying water to the water tub and heating tank, and a steam supply valve for opening and closing the steam supply pipe.

The heating tank may be provided with a water level sensor for sensing a water level in the heating tank, a temperature sensor for sensing an internal temperature of the heating tank, and a pressure sensor for sensing an internal pressure of the heating tank.

The water supply unit may comprise a first water supply pipe for supplying water into the water tub, a first water supply valve for controlling the supply of water of the first water supply pipe, a second water supply pipe for supplying water into the heating tank, and a second water supply valve for controlling the supply of water of the second water supply pipe.

The drum type washing machine may further comprise a hot water supply pipe for guiding hot water from the heating tank into the water tub, and a hot water supply valve for controlling supply of the hot water into the hot water supply pipe.

The steam supply pipe may be provided, at the outlet thereof, with a steam diffusion nozzle for diffused injection of steam.

The steam diffusion nozzle may have an inlet connected to the steam supply pipe, and a plurality of outlets communicated with the inlet for diffused injection of steam introduced into the steam diffusion nozzle through the inlet. The outlets may be inclined at a predetermined angle with respect to a central line of the steam diffusion nozzle.

Additionally in accordance with the present invention, the object is accomplished by performing a method of operating a drum type washing machine, comprising: introducing a first amount of water into a steam generation unit; heating the first amount of water to a first predetermined temperature below boiling to create hot water; introducing the hot water into a tub of the washing machine; introducing a second amount of water into the steam generation unit; heating the second amount of water to a second predetermined to create steam; and introducing the steam into the tub of the washing machine to further heat the hot water to a temperature suitable for operation of the washing machine.

The steam may be diffused when it is introduced into the tub of the washing machine so that it will not harm clothes arranged in the tub.

The temperature and pressure in the steam generation unit may be monitored, and further amounts of water may be introduced therein when the temperature or pressure fall below a predetermined level.

BRIEF DESCRIPTION OF THE DRAWINGS

The above objects, and other features and advantages of the present invention will become more apparent after reading the following detailed description of exemplary embodiments of the invention, read in conjunction with the drawings, in which.

DETAILED DESCRIPTION OF EXEMPLARY EMBODIMENTS

Exemplary embodiments of the present invention will now be described in detail with the annexed drawings. The described exemplary embodiments are intended to assist the understanding of the invention, and are not intended to limit the scope of the invention in any way.

Figure 1:
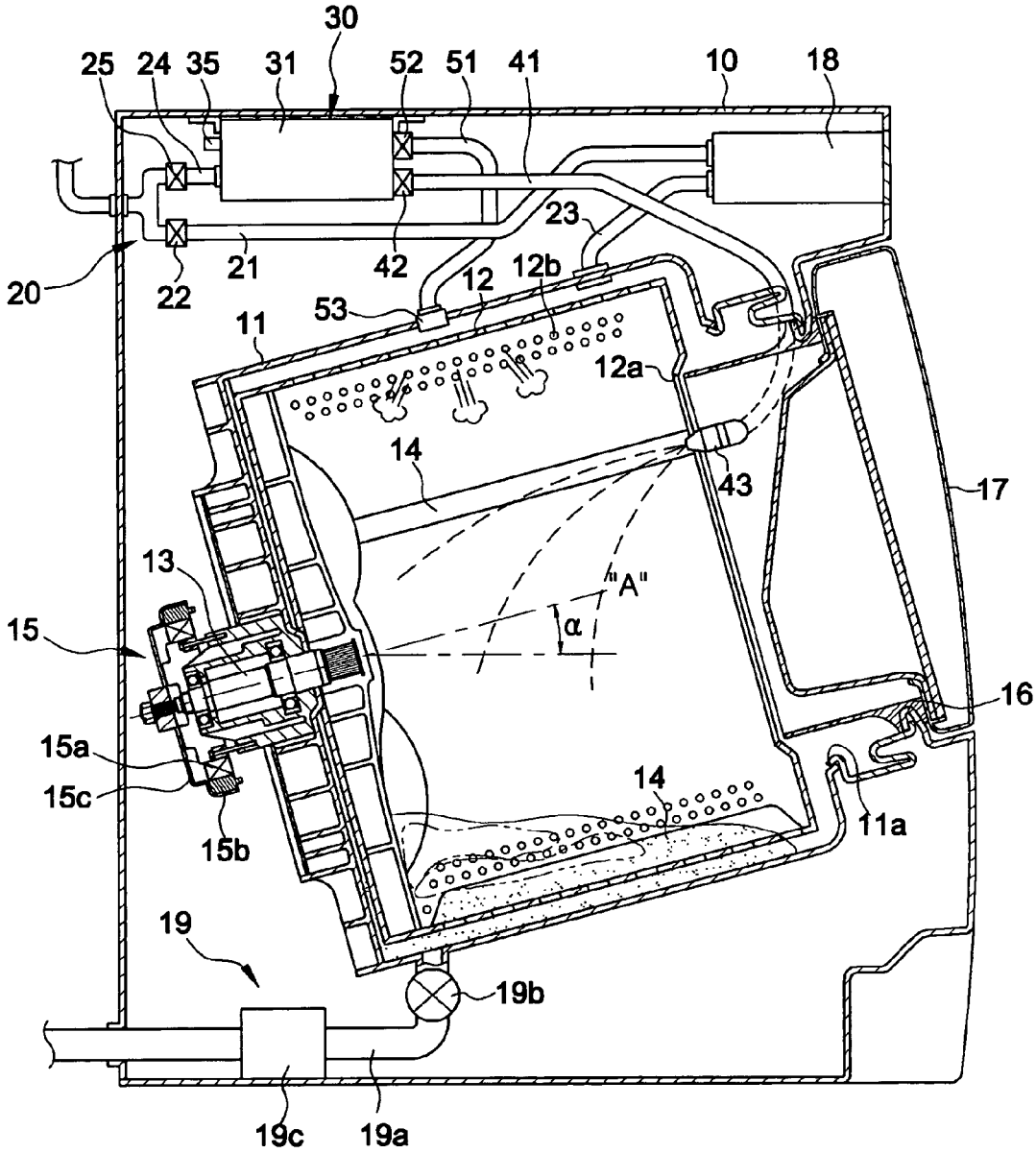
FIG. 1 is a sectional view illustrating the overall configuration of a drum type washing machine according to an exemplary embodiment of the present invention in which a steam supply pipe is connected to a peripheral wall of a water tub.

Referring to FIG. 1, a drum type washing machine according to an exemplary embodiment of the invention is illustrated. As shown in FIG. 1, the drum type washing machine includes a housing 10, a drum-shaped water tub 11 mounted in the housing 10, and adapted to contain wash water, and a rotating drum 12 rotatably mounted in the water tub 11.

The water tub 11 in the housing 10 is inclined at a certain angle a with respect to an installation surface, on which the drum type washing machine is installed, such that its front wall provided with an access opening 11a is positioned at a level higher than that of its rear wall. The rotating drum 12, which is mounted in the water tub 11, is inclinedly arranged with respect to the installation surface in the same fashion as that of the water tub 11 such that its front wall provided with an access opening 12*a* is positioned at a level higher than that of its rear wall. That is, the rotating drum 12 is arranged such that its rotation axis(i.e., center line A) is inclined at the angle a with respect to the installation surface, so as to cause its front wall provided with the access opening 12*a* to be forwardly and upwardly directed. A rotating shaft 13 is fixedly mounted, at one end thereof, to a central portion of the rear wall of the rotating drum 12 inside the rotating drum 12. The rotating shaft 13 is also rotatably supported by a central portion of the rear wall of the water tub 11. Accordingly, the rotating drum 12 is rotatable within the water tub 11. A plurality of through holes 12*b* are formed at a peripheral wall of the rotating drum 12. A plurality of lifters 14 are mounted on an inner peripheral surface of the rotating drum 12, so as to raise laundry in the rotating drum 12, and then to release the raised laundry, thereby causing the laundry to be dropped, during rotation of the rotating drum 12.

A driving unit, that is, a motor 15, is mounted to the rear wall of the water tub 11 outside the water tub 11, so as to rotate the rotating shaft 13 mounted to the rotating drum 12. The motor 15 includes a stator 15*a* fixed to the rear wall of the water tub 11, a rotor 15*b* rotatably arranged around the stator 15*a*, and a rotating plate 15*c* connecting the rotor 15*b* to the rotating shaft 13. An access opening 16 is formed at a front wall of the housing 10. The access opening 16 is aligned with the access openings 11*a* and 12*a* respectively formed at the water tub 11 and rotating drum 12, so as to allow the user to put laundry into the rotating drum 12 and to take laundry out of the rotating drum 12. Mounted to the access opening 16 is a door 17 adapted to open and close the access opening 16.

Arranged at an upper portion of the water tub 11 are a detergent supply unit 18 for supplying detergent into the water tub 11, a steam generating unit 30 for generating steam and hot water, steam and hot water supply units for supplying the steam and hot water generated from the steam generating unit 30 into the water tub 11, and a water supply unit 20 for supplying water into both the water tub 11 and the steam generating unit 30. A drainage unit 19 is mounted at a lower portion of the water tub 11 in order to drain water from the water tub 11. The drainage unit 19 includes a drainage pipe 19*a*, a drainage valve 19*b*, and a drainage motor 19*c*.

The detergent supply unit 18 is defined therein with a chamber for receiving detergent. In order to allow the user to easily put detergent into the chamber, the detergent supply unit 18 is arranged at the front wall of the housing 10. The water supply unit 20 includes a first water supply pipe 21 for supplying water toward the water tub 11, and a first water supply valve 22 arranged in the first water supply pipe 21 to control the supply of water to the first water supply pipe 21. The first water supply pipe 21 is connected to the detergent supply unit 18 in order to supply water from an external water supply source to the detergent supply unit 18. A separate connecting pipe 23 is connected between the detergent supply unit 18 and the water tub 11, in order to feed water emerging from the detergent supply unit 18 into the water tub 11. As water is introduced into the water tub 11 via the detergent supply unit 18, the detergent contained in the detergent supply unit 18 can be supplied to the water tub 11 in a state of being dissolved in the water. For supply of water to the steam generating unit 30, in addition to the supply of water to the detergent supply unit 18, the water supply unit 20 also includes a second water supply pipe 24, and a second water supply valve 25 arranged in the second water supply pipe 24 to control the supply of water to the steam generating unit 30.

Figure 2:
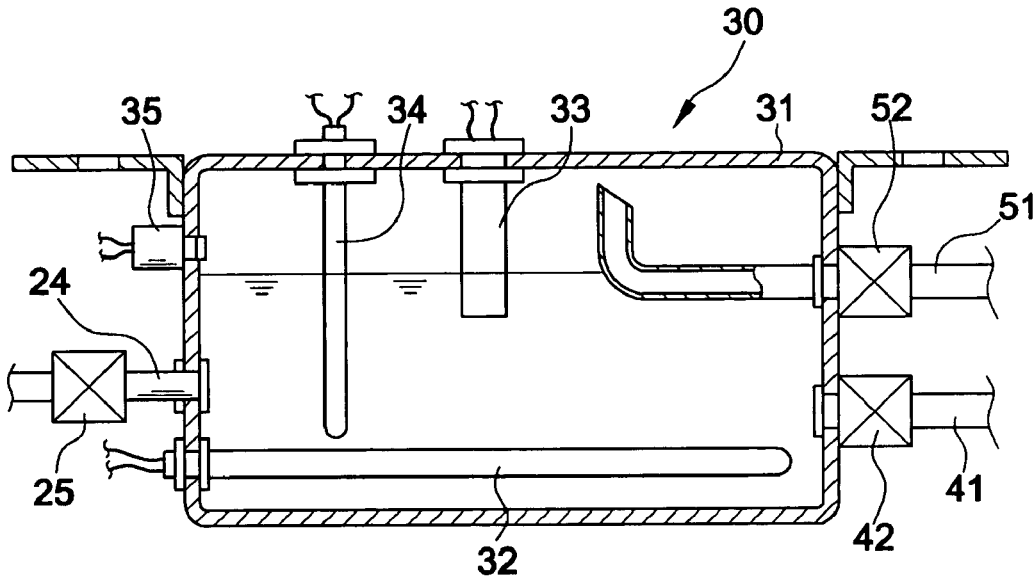
FIG. 2 is sectional view illustrating a steam generating unit included in the drum type washing machine according to the exemplary embodiment of the present invention.

As shown in FIG. 2, the steam generating unit 30 includes a heating tank 31 having a sealed container structure to receive a certain amount of water, and a heater 32 for heating the water received in the heating tank 31, thereby generating steam and hot water. The steam generating unit 30 also includes a water level sensor 33 for controlling the level of water in the heating tank 31, a temperature sensor 34 for controlling the internal temperature of the heating tank 31, and a pressure sensor 35 for controlling the internal pressure of the heating tank 31.

The heater 32 is arranged at a lower portion of the heating tank 31 inside the heating tank 31 such that it is dipped in the water received in the heating tank 31. The second water supply pipe 24 is connected to the heating tank 31 at one side of the heating tank 31, in order to supply water into the heating tank 31. At the other side of the heating tank 31, the steam and hot water supply units are connected to the heating tank 31, in order to supply steam and hot water to the water tub 11.

As shown in FIGS. 1 and 2, the hot water supply unit includes a hot water supply pipe 41 connected between the lower portion of the heating tank 31 and the access opening 12*a* of the rotating drum 12 to guide hot water from the heating tank 31 to the water tub 11 via the rotating drum 12, and a hot water supply valve 42 arranged in the hot water supply pipe 41 to control the supply of hot water through the hot water supply pipe 41. The hot water supply pipe 41 is connected, at an inlet thereof, to a side wall of the heating tank 31 at the lower portion of the heating tank 31. A hot water injection nozzle 43 is mounted to an outlet of the hot water supply pipe 41 in order to inject hot water from the hot water supply pipe 41 onto laundry contained in the rotating drum 12. With this configuration, the hot water supply unit can supply, into the rotating drum 12, hot water produced through a water heating operation of the heater 32 installed in the heating tank 31.

The steam supply unit includes a steam supply pipe 51 connected between an upper portion of the heating tank 31 and the water tub 11 to guide steam from the heating tank 31 to the water tub 11, a steam supply valve 52 arranged in the steam supply pipe 51 to control the supply of steam through the steam supply pipe 51, and a steam diffusion nozzle 53 mounted to an outlet of the steam supply pipe 51 to guide diffused injection of the steam supplied through the steam supply pipe 51 into the water tub 11. In order to receive only steam from the interior of the heating tank 31, the steam supply pipe 51 extends horizontally into the interior of the heating tank 31 at the side wall of the heating tank 31, and is then bent to extend upwardly in the heating tank 31 so that its inlet is positioned at an upper portion of the heating tank 31 inside the heating tank 31. With this configuration, the steam supply unit can supply steam into the water tub 11, thereby causing wash water contained in the water tub 11 to be heated by the supplied steam. Thus, it is possible to rapidly increase the temperature of the wash water to an appropriate temperature for effective wash.

Figure 4:
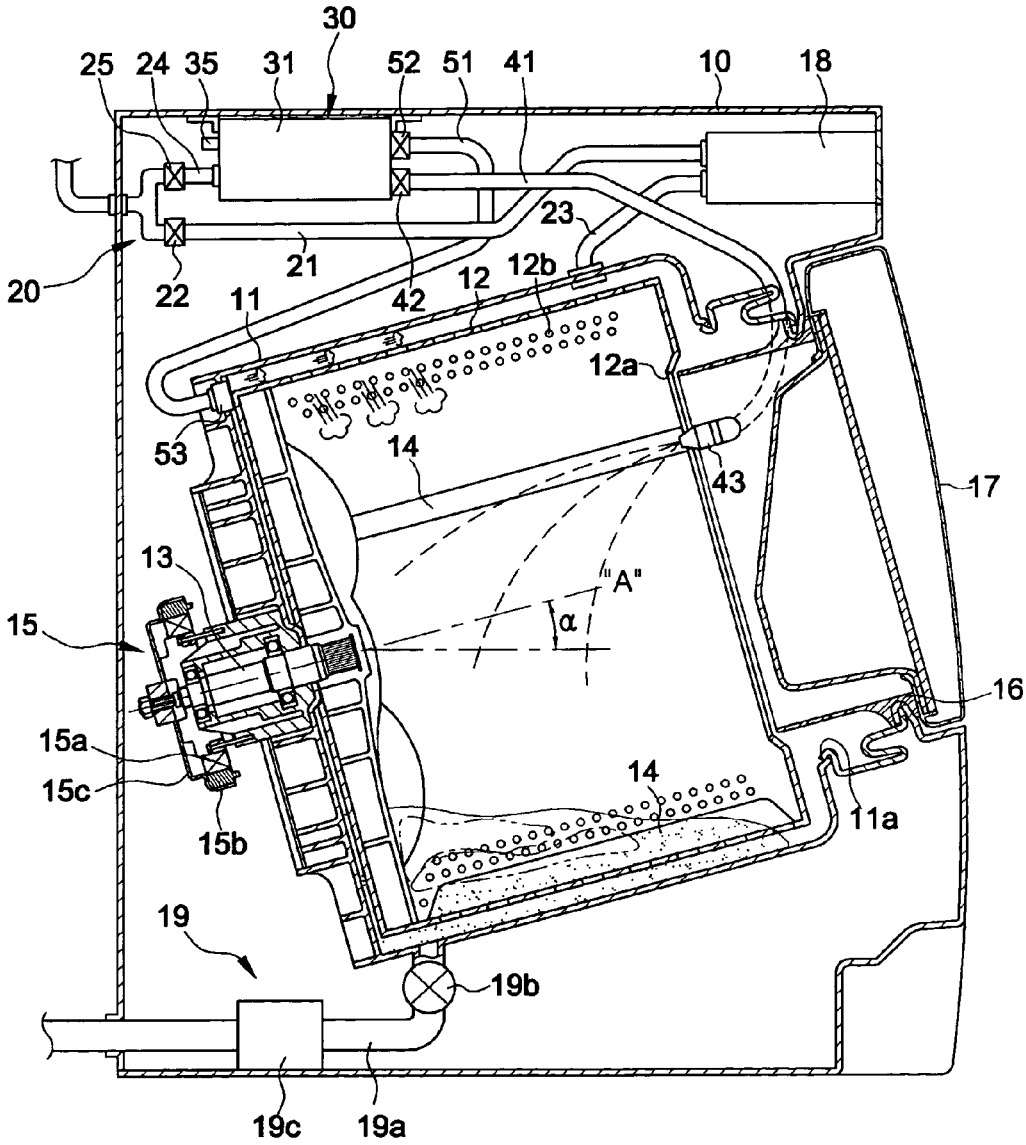
FIG. 4 is a sectional view illustrating the overall configuration of a drum type washing machine according to another exemplary embodiment of the present invention in which a steam supply pipe is connected to a rear wall of a water tub.

The outlet of the steam supply pipe 51 connected to the water tub 11 may be connected to a top portion of a peripheral wall of the water tub 11, as shown in FIG. 1. Alternatively, the outlet of the steam supply pipe 51 may be connected to the rear wall of the water tub 11, as shown in FIG. 4. In accordance with such an arrangement, it is possible to prevent steam from being directly injected onto laundry contained in the rotating drum 12, thereby preventing the laundry from being damaged due to heat emitted from the steam, which is injected under high pressure. That is, the steam supplied into the water tub 11 is injected toward the peripheral or rear wall of the rotating drum 12, so that it is diffused along the peripheral or rear wall of the rotating drum 12 after striking the wall, and is then introduced into the rotating drum 12 through the through holes 12*b* formed at the rotating drum 12.

Figure 3:
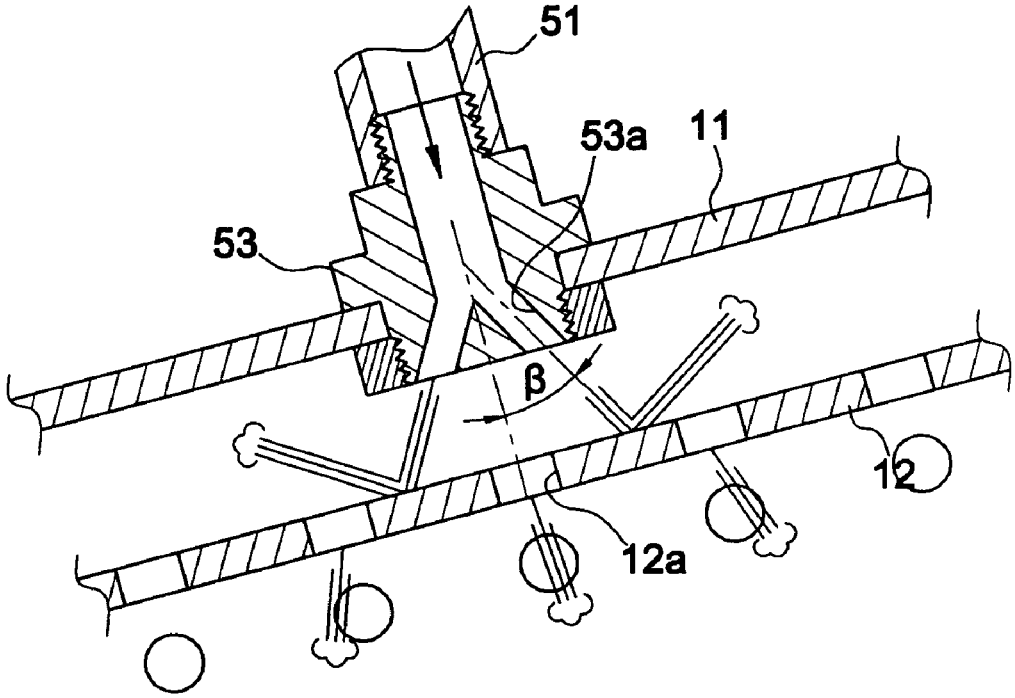
FIG. 3 is a sectional view illustrating a steam diffusion nozzle included in the drum type washing machine according to the exemplary embodiment of the present invention.

The steam diffusion nozzle 53 mounted to the outlet of the steam supply pipe 51 is fixed to the water tub 11, as shown in FIG. 3. The steam diffusion nozzle 53 has an inlet connected to the output of the steam supply pipe 51, and a plurality of outlets 53*a* inclined at a certain angle β with respect to a central line of the steam diffusion nozzle 53 such that steam introduced into the steam diffusion nozzle 53 through the inlet thereof is radially outwardly diffused while being injected into the water tub 11.

With this configuration, it is possible to spread the steam, injected toward the outer surface of the rotating drum 12, over the entire portion of the outer rotating drum surface without being concentrated onto a local portion of the outer rotating drum surface. Thus, it is possible to reduce noise caused by the injection of steam while achieving simple diffusion of the steam.

Now, the overall operation of the drum type washing machine having the above described configuration will be described.

When the drum type washing machine is initially operated under the condition in which laundry has been put into the rotating drum 12, and detergent has been put into the detergent supply unit 18, in order to perform a washing process, the first and second water supply valves 22 and 25 are opened under the control of a control unit (not shown), thereby causing water to be supplied to both the detergent supply unit 18 and the steam generating unit 30. At this time, the detergent contained in the detergent supply unit 18 is supplied into the water tub 11 in a state of being dissolved in the water supplied into the water tub 11 via the detergent supply unit 18. After a desired amount of water is supplied into the water tub 11 via the first water supply pipe 21, the first water supply valve 22 is closed, thereby cutting off the supply of water to the first water supply pipe 21.

Meanwhile, the steam supply valve 52 and hot water supply valve 42 at the side of the steam generating unit 30 are initially maintained in a closed state. Accordingly, the water supplied toward the steam generating unit 30 is introduced into the heating tank 31. Once the water fills the heating tank 31, the control unit controls, based on a sensing operation of the water level sensor 33, the second supply valve 25 to be opened or closed such that the water in the heating tank 31 is maintained at a desired level. In this state, the control unit drives the heater 32 to heat the water in the heating tank 31.

When the water in the heating tank 31 is heated to a predetermined temperature of about 30° C. in accordance with the heating operation of the heater 32, the control unit controls the hot water supply valve 42 to be opened, so that hot water from the heating tank 31 is supplied into the water tub 11 via the rotating drum 12. When the control unit senses, based on a sensing operation of the temperature sensor 34, that the temperature of the water in the heating tank 31 has reached the predetermined temperature, that is, 30° C., it opens the hot water supply valve 42, thereby causing the hot water to be supplied to the water tub 11 via the rotating drum 12. On the other hand, when the control unit senses, based on the sensing operation of the water level sensor 33, an excessive lowering of the water level in the heating tank 31 caused by the supply of hot water, it controls the second water supply valve 25 to be opened. Thus, the water level in the heating tank 31 is maintained at a desired level. As the above control operations are repeatedly carried out, hot water is continuously supplied into the water tub 11 via the rotating drum 12.

Once an appropriate amount of hot water, required for a washing process, is supplied into the water tub 11, the hot water supply valve 42 is closed, thereby cutting off the supply of hot water. In this state, the water in the heating tank 31 is continuously heated by the heater 32, so that steam is generated. When the internal pressure of the heating tank 31 is increased to a predetermined steam supply pressure in accordance with the generation of steam, the control unit senses this state through the pressure sensor 35, and opens the steam supply valve 52 to supply steam into the water tub 11. Accordingly, the wash water contained in the water tub 11 is heated by the steam. At this time, the steam is supplied into the water tub 11 through the steam diffusion nozzle 53 directed, outside the rotating drum 12, to the peripheral or rear wall of the rotating drum 12, so that it is injected onto the laundry contained in the rotating drum 12 in an indirect fashion. Accordingly, it is possible to prevent the laundry from being damaged by the steam. In particular, the steam is diffused throughout the interior of the water tub 11, so that it uniformly heats the wash water.

During such a steam supplying operation, the control unit controls the supply of steam into the water tub 11 by controlling the steam supply valve 52 in such a manner that the steam supply valve 52 is closed when the internal pressure of the heating tank 31 is excessively lowered, while being opened when the internal pressure of the heating tank 31 is excessively increased. When the water level in the heating tank 31 is excessively lowered during the steam supplying operation, the control unit also opens the second water supply valve 25 so as to supply water into the heating tank 31. This steam supplying operation is continued until the temperature of the wash water in the water tub 11 reaches a predetermined temperature for effective wash. For example, where the predetermined wash temperature is 60° C., the steam supplying operation is continued until the water in the water tub 11, which is maintained at about 30° C. by virtue of the hot water supplied into the water tub 11 via the rotating drum 12, is increased in temperature to 60° C. as it is heated by the supplied stem. The water level and water temperature in the water tub 11 are sensed by an additional water level sensor and an additional water temperature sensor, which are not shown.

Since water is supplied into the water tub 11 via the rotating drum 12 in a state of being heated by the heater 32 of the steam generating unit 30, and the resultant hot water received in the water tub 11 is again heated by steam supplied into the water tub 11, in accordance with the present invention, it is possible to rapidly increase the temperature of wash water, and thus, to reduce the overall wash time, as compared to conventional drum type washing machines in which wash water is heated by a heater installed at a wash tub.

Once the wash water is heated to the predetermined wash temperature by the steam supplied into the water tub 11, the supply of steam is cut off. In this state, the rotating drum 12 performs a washing operation while being rotated at low speed in accordance with operation of the motor 15. After completion of the washing process, a rinsing process involving repetition of spin-drying and water supplying operations is carried out. The supply of water into the water tub 11 in the rinsing process is carried out through the first water supply pipe 21 in an opened state of the first water supply valve 22. During the spin-drying operation, drainage of water from the water tub 11 is carried out in accordance with operation of the drainage pump 19*c* in an opened state of the drainage valve 19*b*. After the rinsing process, a spin-drying process is carried out. In the spin-drying process, the drainage pump 19*c* is operated in the opened state of the drainage valve 19*b*. In this state, the rotating drum 12 is rotated at high speed for a predetermined time, thereby spin-drying the laundry.

As apparent from the above description, the present invention provides a drum type washing machine in which water is supplied into the water tub in a state of being heated by a heater included in a steam generating unit, and steam generated from the steam generating unit is also supplied into the water tub to heat the wash water in the water tub to a desired wash temperature. Accordingly, the drum type washing machine of the present invention can rapidly increase the temperature of wash water, thereby reducing the overall wash time, as compared to conventional drum type washing machines.

In the drum type washing machine of the present invention, it is unnecessary to provide a space for installation of a separate heater at the lower portion of the water tub, as compared to conventional drum type washing machines. Accordingly, the amount of wash water to fill the water tub is reduced by an amount of water to fill the space. Thus, it is possible to reduce the amount of wash water to be used, and to reduce the energy consumed to heat the wash water.

In the drum type washing machine of the present invention, the supply of steam into the water tub is carried out in such a fashion that the steam is directed to the peripheral or rear wall of the rotating drum. Accordingly, the steam is diffused throughout the interior of the water tub, so that it uniformly heats the wash water. It is also possible to prevent the steam from being directly injected onto the laundry contained in the rotating drum, and thus, to prevent the laundry from being damaged by the steam injected under high pressure.

Although exemplary embodiments of the invention have been disclosed for illustrative purposes, the invention is not limited to the embodiments described above. Those skilled in the art will appreciate that various modifications, additions and substitutions are possible, without departing from the scope and spirit of the invention as defined with reference to the accompanying claims.

What is claimed is:

1. A drum type washing machine comprising:

a water tub for containing wash water;

a rotating drum, rotatably mounted in the water tub, comprising a plurality of through holes formed along a peripheral wall thereof;

a heating tank for containing water and generating hot water and steam, comprising a heater for heating the water contained therein;

a steam supply pipe, adapted to guide the steam from the heating tank to the water tub, comprising an inlet connected to the heating tank and an outlet connected to the water tub; and a hot water supply pipe, adapted to guide heated water from the heating tank to the water tub, comprising an inlet connected to the heating tank and an outlet connected to the water tub, wherein the inlet of the steam supply pipe extends horizontally into an interior of the heating tank at a side wall of the heating tank, and is bent to extend upwardly in the interior of the heating tank so that the inlet is positioned at an upper portion of the heating tank inside the heating tank, and wherein the inlet of the hot water supply pipe is connected to a side wall of the heating tank so as to be dispose at a lower portion of the heating tank than the inlet of the steam supply pipe, and wherein heated water and steam are capable of being simultaneously and separately supplied to the water tub via the hot water supply pipe and the steam supply pipe, respectively.

2. The drum type washing machine according to claim 1, further comprising a water supply unit for supplying water to the water tub and heating tank.

3. The drum type washing machine according to claim 2, wherein the water supply unit comprises:

a first water supply pipe for supplying water into the water tub;

a first water supply valve for controlling the supply of water of the first water supply pipe;

a second water supply pipe for supplying water into the heating tank; and a second water supply valve for controlling the supply of water of the second water supply pipe.

4. The drum type washing machine according to claim 1, wherein the outlet of the steam supply pipe is connected to the water tub at a peripheral wall of the water tub.

5. The drum type washing machine according to claim 1, wherein the outlet of the steam supply pipe is connected to the water tub at a rear wall of the water tub.

6. The drum type washing machine according to claim 1, further comprising a steam supply valve for opening and closing the steam supply pipe with respect to the heating tank.

7. The drum type washing machine according to claim 1, wherein the heating tank further comprises: a water level sensor for sensing a water level in the heating tank; a temperature sensor for sensing an internal temperature of the heating tank; and a pressure sensor for sensing an internal pressure of the heating tank.

8. The drum type washing machine according to claim 7, further comprising a water supply unit for supplying water to the water tub and heating tank, wherein the water supply unit comprises:

a first water supply pipe for supplying water into the water tub;

a first water supply valve for controlling the supply of water of the first water supply pipe;

a second water supply pipe for supplying water into the heating tank; and a second water supply valve for controlling the supply of water of the second water supply pipe.

9. The drum type washing machine according to claim 7, further comprising:

a hot water supply valve for controlling supply of the hot water from the heating tank into the hot water supply pipe.

10. The drum type washing machine according to claim 1, further comprising:

a hot water supply valve for controlling supply of the hot water from the heating tank into the hot water supply pipe.

11. The drum type washing machine according to claim 1, wherein the steam supply pipe is provided, at the outlet thereof, with a steam diffusion nozzle for diffused injection of steam.

12. The drum type washing machine according to claim 11, wherein the steam diffusion nozzle comprises: an inlet connected to the steam supply pipe; and a plurality of outlets communicated with the inlet for diffused injection of steam introduced into the steam diffusion nozzle through the inlet, wherein the outlets are inclined at a predetermined angle with respect to a central line of the steam diffusion nozzle.

* * * * *